United States Patent [19]

Henriksson et al.

[11] Patent Number: 4,475,441

[45] Date of Patent: Oct. 9, 1984

[54] ELECTROHYDRAULIC SET DEVICE

[76] Inventors: Göran Henriksson, Backsippestigen 4, S-575 00 Eksjö; Sune Lindahl, Trägårdsgaten 14, S-570 34 Mariannelund, both of Sweden

[21] Appl. No.: 305,643

[22] PCT Filed: Jan. 23, 1981

[86] PCT No.: PCT/SE81/00015

§ 371 Date: Sep. 21, 1981

§ 102(e) Date: Sep. 21, 1981

[87] PCT Pub. No.: WO81/02185

PCT Pub. Date: Aug. 6, 1981

[30] Foreign Application Priority Data

Jan. 24, 1980 [SE] Sweden ..... 8000575

[51] Int. Cl.[3] ..... F15B 13/16

[52] U.S. Cl. ..... 91/387; 91/459

[58] Field of Search ..... 91/387, 459

[56] References Cited

U.S. PATENT DOCUMENTS 2,752,891 7/1956 Farkas ..... 91/387

2,966,891 1/1961 Williams ..... 91/387

3,131,608 5/1964 Yando ..... 91/387

3,208,352 9/1965 Lucien ..... 91/387

FOREIGN PATENT DOCUMENTS 22087 2/1979 Japan ..... 91/387

*Primary Examiner*—Paul E. Maslowsky

*Attorney, Agent, or Firm*—McGlew and Tuttle

[57] ABSTRACT

An electrohydraulic set device includes, as an output element, a piston which is operable by a hydraulic pressure against the action of a return force. The hydraulic pressure is led to the working side of the piston via a valve passage. The valve passage is opened and closed by an electromagnet operated control slide. The control slide is arranged along a piston rod connected to the piston together with a coil of the electromagnet, the armature being arranged therebetween, in a common chamber, of which the working side of the piston forms part. A spring force between the control slide and the piston tends to move the slide against the action of the magnetic force in a direction closing the passage. The control slide lies to the side of the piston.

9 Claims, 6 Drawing Figures

ELECTROHYDRAULIC SET DEVICE

FIELD AND BACKGROUND OF THE INVENTION

The present invention relates, in general, to setting means for electrohydraulic devices, and in particular to a new and useful setting device which utilizes a control slide slidably mounted to the side of a piston to be controlled by the control slide.

SUMMARY OF THE INVENTION

A very favourable support of the electro-magnet armature, that essentially eliminates all friction in connection with the movements thereof and of the slide is obtained, according to a particular aspect of the invention in a set device for operating a hydraulic control slide by means of the armature of an electromagnet, characterized in that the armature is suspended in spring means permitting movement of the armature in the length direction of the slide, and that the slide is unrigidly connected to the armature by means of at least one driving surface movable with the armature.

BRIEF DESCRIPTION OF THE DRAWING

The invention will now be described more closely below with reference to embodiments shown on the attached drawings, wherein.

DESCRIPTION OF THE PREFERRED EMBODIMENTS

Figure 1:
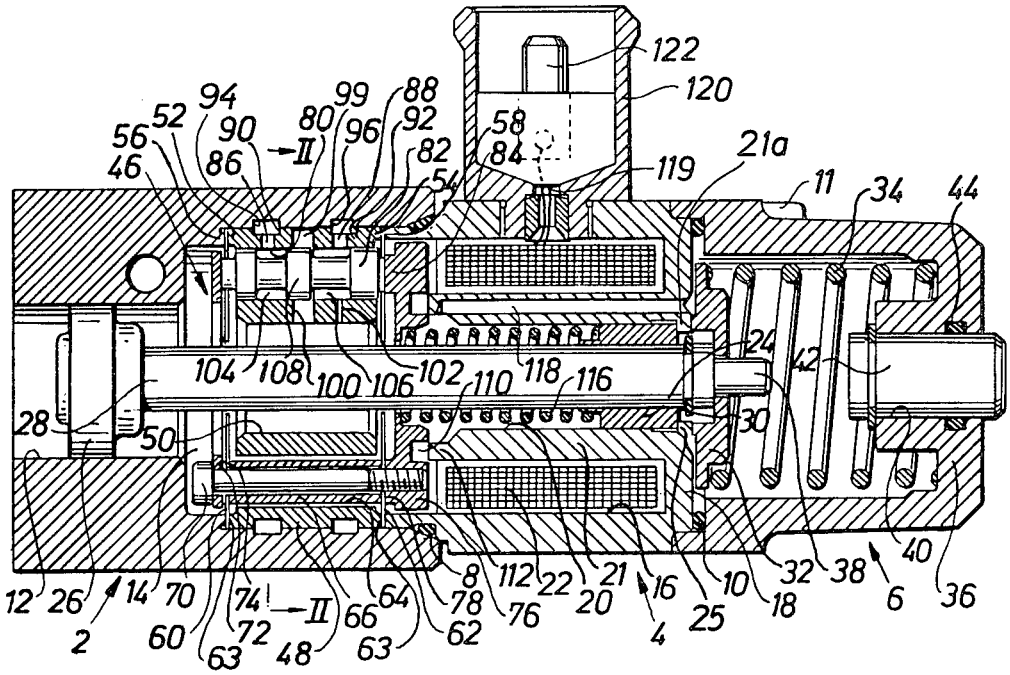
FIG. 1 shows an embodiment of the set device in axial section.

For an understanding of the principles of the invention, reference is made to the following description of typical embodiments thereof as illustrated in the accompanying drawings.

The housing of the inventive set device is composed of three portions 2, 4 and 6. The housing portions 2,4 and 6 are sealingly connected to each other essentially end to end via O-ring seal 8 and 10. More particularly the connections consist of axial bolt joints through outer extensions of the walls of the three housing portions. At 11 of these bolt joints is indicated.

The housing portion 2 along a part of its length has a central bore 12 and along the remainder of its length a cylindrical chamber 14 widening from the bore 12. The chamber 14 is opened towards the interior of the housing portion 4, said interior being composed of an outer, cylinder shaped space 16, which is closed by a wall 18 at the other end of the housing portion 4, and a central through bore 20. The space 16 and bore 20 are separated by a cylinder shaped part 21 of the housing portion 4. The space 16 encloses an embedded electromagnet coil 22. In the central bore 20 a sleeve 24 is glidably guided.

The boring 20 at its end remote from the housing portion 2 has a stop abutment 25 for the sleeve 24.

The bore 12 of the housing portion 2 forms a cylinder bore for a piston 26 with a piston rod 28, which is glidably guided in the sleeve 24. At its end remote from the piston 26 the piston rod 28 has a peripheral groove for a lock ring 30.

The inwardly directed movement (to the right in FIG. 1) of the piston 26 is restricted by a disc 32 that is kept pressed against the end of the housing portion 4 by means of a compression spring 34 acting between the disc 32 and the end wall 36 of the housing portion 6. Through a central hole in the disc 32 an end pin 38 of the piston rod 28 extends into the housing portion 6. The wall 36 has a central hub with a through hole 40, through which a bolt 42 extends glidably and sealingly by means of an O-ring seal 44.

The chamber 14 contains a control slide and armature unit 46. Said unit includes a cylindric body 48, the outer peripheral surface of which abuts against the inner cylindric wall of the chamber 14 and that has a great axial through hole 50 for the piston rod 28. The body 48 at each end has an axially protruding annular edge 52 and 54, respectively, and is clamped between an annular shoulder 56 in the chamber 14 and an annular end rim 58 of the housing portion 4 with spring discs 60 and 62, respectively, inserted on each side of the body 48. More particularly the spring disc 60 has an annular peripheral edge 63 clamped between the edge 52 and the shoulder 56 and the spring disc 62 in the same way has an annular peripheral edge 63 clamped between the rims 54 and 58.

Through the body 48 and radially displaced with respect to the hole 50 three uniformly distributed bores 64 extend, each of which with play containing a spacer sleeve 66. The length of the spacer sleeves 66 corresponds to the distance between the rims 52 and 54. Through the spacer sleeves 66 extends each a bolt 68. Between a head 70 of the bolt and the spacer sleeves 66 are in turn a driving ring 72 with three equally distributed holes for the bolts 68, a spacer disc 74, and a portion 75 of the spring disc 60 clamped. The other ends of the bolts 68 are screwed into an electromagnet armature 76 to be described more closely below, so that a spacer projection 78 of the armature 76 and the spacer sleeves 66 between them clamp corresponding portions 75 of the spring disc 62. The portions 75 of the spring discs 60 and 62 which are clamped at each end of the spacer sleeves are located on tongues 79 resiliently carried with respect to the annular clamped edges of the spring discs, said tongues 79 being so shaped that the unit consisting of the ring 72, the spacer sleeves and the armature 76 is restrictedly freely resiliently movable in axial direction with respect to the body 48.

Radially shifted with respect to the bore 50 a cylinder bore 80 for a control slide 82 extends through the body 48, the end surfaces of said control slide glidably abutting the ring 72 and a spacer extension 84 on the armature 76, respectively. The cylinder bore 80 has two holes 86 and 88 leading to each an annular groove 90 and 92, respectively, around the whole periphery of the body 48. The grooves 90, 92 form together with corresponding grooves 94 and 96, respectively, in the cylindric wall of the chamber 14 channels which via holes 97 open towards the outer plane side walls 98 of the housing portion 2. The body 48 furthermore between the holes 86 and 88 has a peripheral transversely extending arcuate hole or slit 99 down to the cylinder bore 80, said slit also traversing the bore for one of the three above mentioned spacer sleeves. Thereby the slit 99 via the play around this spacer sleeve communicates with the inner of the housing of the set device. This connection, via which the bore 80 at a certain position of the slide 82 can be put into connection with the interior of the set device in a way to be described more closely bleow, has on the drawing for the sake of clarity been represented with an passage or hole 100 between the bore 80 and the central boring 50. Furthermore, a leak passage, indicated with a hole 102, form the inner of the house portions 2 and 4 opens in the portion of the bore 80 that contains the hole 88.

The control slide 82 at its periphery has two broad annular recesses 104 and 106, respectively, separated by an intermediate portion 108 of the slide in sealing slide contact with the wall of the bore 80. The recess 104 always via the hole 86 communicates with the channel 90, 94 and the recess 106 always via the hole 88 communicates with the channel 92, 96. The portion 108 of the control slide has a width just overlapping the width of the hole 99, i.e. in one position the slide 82 can completely break the connection between the bore 80 and the inner of the housing portions 2 and 4. The slide 82, however, has a zero position in which the edge of the portion 108 facing the recess 104 just overlaps the edge of the recess 104 and the other edge of the portion 108 leaves a connection between the recess 106 and the hole 99. In this position the inner of the housing portions 2 and 4 is thus closed with respect to the channel 90, 94, but open to channel 92, 96.

The armature 76 is disc shaped with a central hole for the piston rod 28. An annular groove 110 is coaxial with the central hole and broader than and located in front of an annular extension 112 from the inner cylinder shaped portion 21 of the housing portion 4. The portion 21 with the extension 112 serves as core of the electro-magnet. The shape of the details 110 and 112 then, of course, serving to conduct and concentrate the magnetic lines of power. Between a central seat of the electromagnet 76 and an opposite seat of the sleeve 24 a pressure coil spring 116 acts that holds the slide 82 in its above mentioned zero position. Through the core portion 21 an axial channel 118 extends opening in the end wall 18 at a gap with respect to the plate 32. Thereby the interior of all three housing portions 2, 4, 6 communicate with each other.

Electric connections 119 to the coil 22 are led via a connection bushing 120. One of the flat-pin shaped contacts is shown at 122. These contacts are preferably embedded in a resin 124 that fills a portion of the bushing 120 and gives an effective sealing to the interior of the operating device.

For operation of the setting device the channel 90, 94 via the corresponding hole 97 is connected to a hydraulic liquid input line and the channel 92, 96 is connected to a return line. At excitation of the electromagnet coil 22 by means of an operating current the armature 76 is attracted towards the initially weak action of the spring 116 and pulls the operating slide 82 until this member opens the connection to the interior of the setting device via the hole 99. This obtains the result that hydraulic liquid flows into the interior of the setting device and its pressure forces the piston 26 to move to the left in FIG. 1. During a short initial period the piston rod 28 then moves freely until the locking ring 30 mounted thereon abuts the end surface of the sleeve 24. This initial free movement has been introduced in the illustrated embodiment of reasons to be described below.

Thereupon the sleeve 24 is brought to follow the movement of the piston and via the spring 116 moves the armature 76 and thereby the sleeve 82 to a position, where the communication between the hydraulic source and the interior of the operating device is disconnected, i.e. the control slide portion 108 covers the hole 99. Due to a small leak flow via the leak passage 102 the piston 26 receives a tendency to move inwardly into the setting device so that the force of the spring 116 becomes weaker and thereby the armature 76 receives a corresponding tendency to move in the same direction. This, however, in turn results in the control slide 82 opening the connection between the channel 90, 94 and the hole 99. The piston 26 thereby receives a position of equilibrium determined by the value of the coil current. The response of the piston 26 to a set current level in the electro magnet coil in fact is very fast and the movement of the piston to the position determined by said current level is taken place practically instantaneously. The shifting of the piston varies linearly with the current.

Stabilization of the operating current for compensating the heating of the coil 22 can be carried through via an outer circuit in a way easily conceivable by one skilled in the art.

Figure 2:
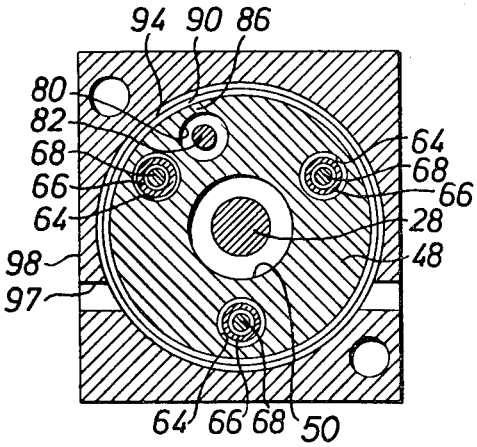
FIG. 2 shows a section in the direction of the arrows II—II in FIG. 1.
Figure 3:
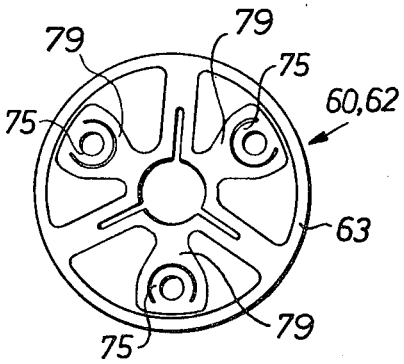
FIG. 3 is a plan view showing a spring disc included in FIG. 2.
Figure 4:
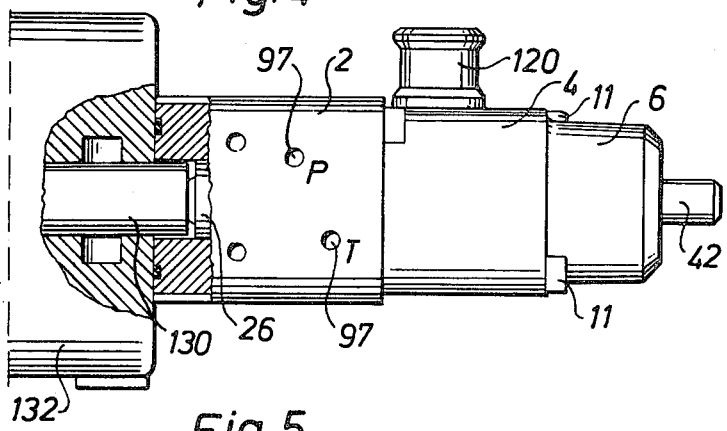
FIG. 4 shows a side view of the set device as connected for operating the valve slide of a hydraulic valve.

The single acting embodiment of the setting device shown in FIGS. 1–3 is intended to be used at operation of hydraulic valves. With reference to FIG. 4 two setting devices for this purpose act against each its end of a valve slide 130 in the hydraulic valve, indicated at 132. In FIG. 4 only the setting device at one end of the valve slide is shown. At operation of the valve slide 130 by means of the piston of one setting device the piston of the other setting device is shifted inwardly against the action of the corresponding pressure spring 34, and vice versa. The piston 26 thus acts against an outer restoring force.

In the actual case the valve slide 130 moves a short distance of an order of magnitude of 2 mm from its throttling position before it begins to let oil through the valve. For using the force of the electromagnet varying linearly with the current supply over the actual control range, i.e. in order to control the oil flow through the hydraulic valve, the above mentioned free motion of the piston 26 has been introduced, which is likewise of an order of magnitude of 2 mm. Thereby the resolution and accuracy is further improved.

By means of the bolt 42 the piston 26 can be manually acted upon for operation, if any, at missing control pressure or current signal. The action of the spring 34 can be replaced by a gas pressure in practice.

Figure 5:
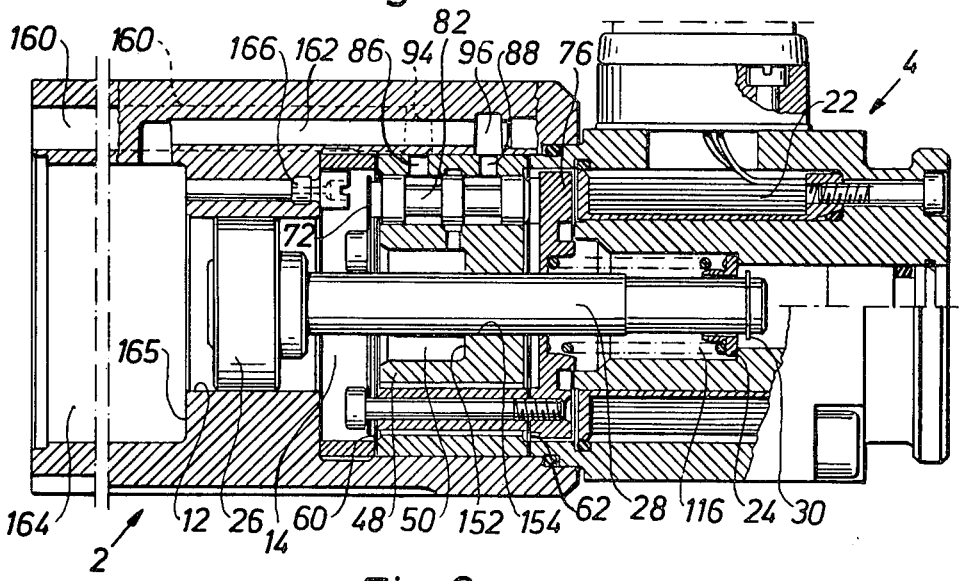
FIG. 5 illustrates a further embodiment of the set device in axial section.

In FIG. 5 a modification of the set device according to FIG. 1 is shown, the same or similarly acting details having the same reference numerals as in FIG. 1. The modified set device at first hand differs from the first embodiment with regard to the suspension of the piston rod 28. More particularly this suspension has been moved from the gliding surface between the bore 20 and the sleeve 24 in FIG. 1 to between the surface of the piston rod 28 and a sliding surface in the body 48. In FIG. 5 the axial hole 50 via an abutment 152 changes into a bore 154, in which the piston rod 28 is movable with slip fit.

Furthermore the housing portion 6 with elements 32,34,42 has been cancelled from the modified embodiment. The action of the spring 34 has been replaced in a way to be described below with reference to FIG. 6.

The body 48 in FIG. 5 lacks the annular grooves 90,92 and instead the grooves 94,96 in the cylindric wall of the chamber 14 have been deepend. The side holes 97 for the pressure fluid connection have been replaced by axially extending channels 160 and 162 from the grooves 94 and 96, respectively. The channel 160 is opening into the end surface of the housing portion 2 and the channel 162 into a central enlarged end chamber 164, that changes into the chamber 12 via an annular abutment surface 165.

The leak connection 102 in FIG. 1 has been replaced by a leak connection 166 to the chamber 164.

For operating the set device according to FIG. 5 the channel 160 is connected to a hydraulic liquid input (pump) and the channel 162 is connected to a return pipe (tank) via the chamber 164.

Figure 6:
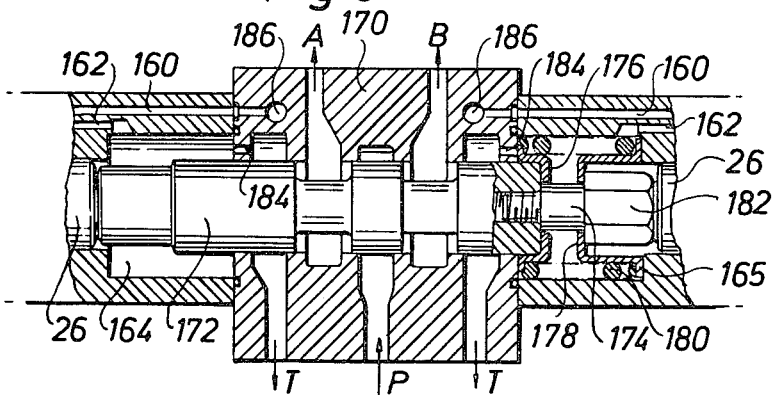
FIG. 6 is a side view and partly in section illustrating how two set devices according to FIG. 5 are used for operating the valve slide of a hydraulic valve.

In FIG. 6 two set devices according to FIG. 5 are shown as connected for operating a hydraulic valve 170. P and T here indicate connections to the hydraulic liquid pump and the tank, respectively. A and B are consumer connections.

Against each end of the valve slide 172 of the valve 170 the piston 26 of the respective set devices act. More particularly, the left end portion of the slide 172, as seen in the figure, is lengthend and extends through the chamber 164 of the corresponding set device into direct contact with the piston 26. At the right end a screw bolt 174 is screwed into the corresponding end portion of the slide 172. Via spring seats 176 and 178 a pressure coil spring 180 acts between the wall of the valve 170 and the head 182 of the bolt 174. The neutral position of the slide 172, shown in the figure, is determined by the fact that the spring seat 178 abuts against the abutment 165 in the set device. Also the pistons 26 then take their neutral positions.

At 184 tank connections through the valve 170 to the respective set device chambers 164 are shown. Pump inputs in the set device 170 to the channels 162 are shown at 186.

It should be realized that, at operating the slide 172 by means of the piston 26, the spring 180 has taken over the action of both springs 34 of the set devices according to FIG. 1 at operation according to FIG. 4.

In practice, setting devices of the kind shown on the drawing have been manufactured at which the ratio between the least possible movement of the piston and its maximum stroke length is 1/1000, i.e. a very accurate setting of the piston can be obtained. The output power depends upon the diameter of the piston and the pressure acting thereupon but these parameters normally do not affect the position of a piston. The setting device does not consume oil in the zero position shown. i.e. when the electromagnet is without current.

Besides the advantages already described above the set device according to the invention the following further advantages and features can be mentioned.

The sensitivity for jet forces appearing in many earlier known set devices when the hydraulic liquid is pressed through narrow valve passages has been essentially eliminated. Only at very high feed pressures jet forces can occur in the control slide, which can cause an insignificant influence on the position of the piston.

By the slidable support of the end surfaces of the control slide 82 on the resiliently supported follower or driving elements 72 and 76 all side forces on the slide are eliminated which could have affected its function.

Due to the design of the set device with the coil enclosing the piston rod and the control slide arranged radially shifted but at a short distance from the piston rod between the coil and the piston a very compact design is obtained. The included components are furthermore in their entirety rugged and simple as is also the design in its entirety.

The area of use of the set device according to the invention is not restricted to that indicated above. It can thus e.g. also be used as a position controlled hydraulic motor (linear power source) where the movements of the piston are arranged to affect e.g. a lever or are transmitted to a rotary movement via a rack. Within the scope of the invention is also an embodiment where the slide surrounds the piston rod.

We claim:

1. An electrohydraulic set device including as an output set element a piston (26) having a piston rod (28), the piston being operable against the action of a force of a hydraulic pressure, that is supplied to an operating side of the piston via a valve passage (100) which is opened and closed by a control slide (82) operated by an electromagnet which can apply a magnetic force, a spring (116) acting between the control slide (82) and the piston (26) such that the spring tends to move the control slide against the action of the magnetic force in a direction closing the passage (100) characterized in that the control slide (82) is radially spaced from the piston rod (28) of the piston (26), the control slide being located together with a coil (22) of the electromagnet and an associated armature (76) in a common chamber with the coil encircling the piston rod, said operating side of the piston being in said common chamber, the armature (76) being suspended in spring means (62) permitting movement of the armature in the length direction of the control slide, and the control slide being abuttingly engageable with the armature and operated by, movement of the armature.

2. A set device according to claim 1, characterized in that the armature (76) of the electromagnet encircles the piston rod (28).

3. A set device according to claim 1, characterized in that a spring force between the control slide and the piston is obtained by the spring (116) which is biased by the armature (76) of the electromagnet in a direction towards the slide (82) to act between the armature (76) and the piston (26).

4. A set device according to claim 3, characterized in that the spring (116) acts between the armature (76) and an abutment element (24), which is arranged to be caught and to follow the piston rod (28) of the piston with movement by the latter due to the action of the hydraulic pressure on the piston (26).

5. A set device according to claim 1, characterized in that the control slide (82) is journalled in a bore (80) with its ends in abutting contact with respective surfaces of interconnected driving elements (72, 76) suspended in said spring means (60,62) permitting movement in the length direction of the slide.

6. A set device according to claim 5, characterized in that one of the driving elements is the armature (76) of the electromagnet.

7. A set device according to claim 5, characterized in that said spring means consist of a spring disc (60,62) for each driving element, said spring disc being clamped at the periphery thereof and having resiliant tongues at which the driving elements are attached.

8. A set device according to claim 5, characterized in that the piston rod (28) of the piston is glidably (154) suspended centrally in a slide housing body (48), that contains the bore (80) of the control slide (82).

9. A set device according to claim 1, wherein the piston rod (28) has an end (38) which is remote from the piston (26) and which is available for outer force action.

* * * * *